US010088783B2

(12) United States Patent
Fukai

(10) Patent No.: US 10,088,783 B2
(45) Date of Patent: Oct. 2, 2018

(54) IMAGE FORMING APPARATUS AND IMAGE FORMING SYSTEM

(71) Applicant: Konica Minolta, Inc., Chiyoda-ku, Tokyo (JP)

(72) Inventor: Shougo Fukai, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/284,222

(22) Filed: Oct. 3, 2016

(65) Prior Publication Data

US 2017/0115611 A1 Apr. 27, 2017

(30) Foreign Application Priority Data

Oct. 22, 2015 (JP) ..... 2015-207861

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/384
See application file for complete search history.

(56) References Cited

U.S. PATENT DOCUMENTS 5,105,227 A * 4/1992 Kitamura ..... B41J 15/04 399/317
5,678,122 A * 10/1997 Gross ..... G03G 15/165 399/16
8,306,441 B2 * 11/2012 Morris ..... G03G 15/55 399/18
8,515,311 B2 * 8/2013 Kishi ..... G03G 15/161 399/121
8,998,516 B2 * 4/2015 Mo ..... B41J 3/54 399/384
2003/0039496 A1 * 2/2003 Miyamoto ..... B41J 3/60 399/384

(Continued)

FOREIGN PATENT DOCUMENTS

JP 11-143254 5/1999
JP 2001-019246 1/2001

(Continued)

OTHER PUBLICATIONS

Decision of Rejection dated Jan. 23, 2018, in Japanese Patent Application No. 2015-207861, 6 pages.

(Continued)

*Primary Examiner* — Anthony Nguyen
(74) *Attorney, Agent, or Firm* — Squire Patton Boggs (US) LLP

(57) ABSTRACT

An image forming apparatus includes: a conveying unit configured to convey a long paper sheet; an image forming unit configured to form an image on the long paper sheet, the image forming unit including a transferring unit configured to transfer toner onto the long paper sheet with a transfer belt; a fixing unit configured to fix the image onto the long paper sheet having the image formed thereon by the image forming unit; and a control unit configured to control a sheet feed path of the long paper sheet with respect to the transfer belt in accordance with state information about the long paper sheet, the long paper sheet being conveyed to the transferring unit by the conveying unit.

8 Claims, 5 Drawing Sheets

(56) References Cited

U.S. PATENT DOCUMENTS

| | | | | |
|---|---|---|---|---|
| 2003/0226459 | A1* | 12/2003 | Langsch | B41F 13/02 101/219 |
| 2004/0258439 | A1* | 12/2004 | Izumi | G03G 15/167 399/316 |
| 2005/0129437 | A1* | 6/2005 | Ishikawa | G03G 15/234 399/384 |
| 2006/0062618 | A1* | 3/2006 | Kobayashi | G03G 15/0131 399/384 |
| 2012/0039646 | A1* | 2/2012 | Condello | G03G 15/2021 399/328 |
| 2014/0294411 | A1* | 10/2014 | Yoshioka | G03G 15/1695 399/45 |

FOREIGN PATENT DOCUMENTS

| | | |
|---|---|---|
| JP | 2002-132965 A | 5/2002 |
| JP | 2006-248158 | 9/2006 |
| JP | 2015-051816 | 3/2015 |

OTHER PUBLICATIONS

Notice of Reasons for Rejection dated Sep. 26, 2017, in Japanese Patent Application No. 2015-207861, 15 pages.

* cited by examiner

IMAGE FORMING APPARATUS AND IMAGE FORMING SYSTEM

The entire disclosure of Japanese Patent Application No. 2015-207861 filed on Oct. 22, 2015 including description, claims, drawings, and abstract are incorporated herein by reference in its entirety.

BACKGROUND OF THE INVENTION

Field of the Invention

The present invention relates to an image forming apparatus that forms an image by transferring and fixing a toner image onto a long paper sheet, and to an image forming system that includes the image forming apparatus.

Description of the Related Art

There have been electrophotographic image forming apparatuses such as printers and copying machines. Such an image forming apparatus includes a sheet feed path that guides a paper sheet in contact with a transfer belt to a transfer nip portion when a toner image is transferred onto the paper sheet. This is to prevent electric discharge at the time when toner is transferred onto the paper sheet.

A structure in which a paper sheet is brought into contact with a transfer belt has been suggested in the form of a technique of pressing a paper sheet against a transfer belt by winding the paper sheet around a transfer roller, with the pressed portion of the transfer roller serving as the transfer belt (see JP 2002-132965 A, for example).

In a structure that conveys a long paper sheet, tension is applied to the long paper sheet being conveyed, so that the long paper sheet will not sag. Therefore, it is difficult to send the long paper sheet into the transfer nip portion while keeping the long paper sheet in contact with the transfer belt. In view of this, the sheet feed path of long paper sheets is designed to extend along the transfer belt.

The tension of a long paper sheet varies depending on sheet class, such as the sheet type or the basis weight of the long paper sheet. As the tension of a long paper sheet varies, the amount of deformation of the transfer roller facing the transfer belt also varies. Even if the sheet feed path of long paper sheets is designed to extend along the transfer belt, electric discharge before the transfer nip might occur in the sheet feed path. Such electric discharge before the transfer nip might further lead to an image defect due to discharge ununiformity.

SUMMARY OF THE INVENTION

The present invention has been made to solve the above problems, and an object thereof is to provide an image forming apparatus and an image forming system that are capable of preventing electric discharge before the transfer nip by maintaining the sheet feed path of long paper sheets in a predetermined route.

To achieve the abovementioned object, according to an aspect, an image forming apparatus reflecting one aspect of the present invention comprises: a conveying unit configured to convey a long paper sheet; an image forming unit configured to form an image on the long paper sheet, the image forming unit including a transferring unit configured to transfer toner onto the long paper sheet with a transfer belt; a fixing unit configured to fix the image onto the long paper sheet having the image formed thereon by the image forming unit; and a control unit configured to control a sheet feed path of the long paper sheet with respect to the transfer belt in accordance with state information about the long paper sheet, the long paper sheet being conveyed to the transferring unit by the conveying unit.

An invention of Item. 2 is the image forming apparatus of Item. 1, preferably further comprising a sheet feed path adjusting unit configured to adjust the sheet feed path in a plane direction of the long paper sheet with respect to the transfer belt, the sheet feed path adjusting unit being disposed on an upstream side of the transfer belt in a direction of conveyance of the long paper sheet being conveyed to the transferring unit by the conveying unit.

An invention of Item. 3 is the image forming apparatus of Item. 1 or 2, preferably further comprising a sheet position sensing unit configured to acquire the state information about the long paper sheet by sensing a position of the long paper sheet in a plane direction thereof on an upstream side of the transfer belt in a direction of conveyance of the long paper sheet being conveyed to the transferring unit by the conveying unit, wherein the control unit preferably controls the sheet feed path in the plane direction of the long paper sheet in accordance with the position of the sheet feed path of the long paper sheet sensed by the sheet position sensing unit.

An invention of Item. 4 is the image forming apparatus of Item. 1 or 2, wherein the control unit preferably controls the sheet feed path in a plane direction of the long paper sheet in accordance with the state information about the long paper sheet, the state information specifying the class of the long paper sheet.

An invention of Item. 5 is the image forming apparatus of Item. 1 or 2, wherein the control unit preferably displays an adjustment screen for adjusting the sheet feed path of the long paper sheet, and controls the sheet feed path in a plane direction of the long paper sheet in accordance with an operation performed on the adjustment screen.

An invention of Item. 6 is the image forming apparatus of Item. 1, wherein the transferring unit preferably includes a transfer roller configured to press the long paper sheet against the transfer belt, and the control unit preferably controls a pressing force of the transfer roller against the transfer belt in accordance with the state information about the long paper sheet.

To achieve the abovementioned object, according to an aspect, an image forming system reflecting one aspect of the present invention comprises: an image forming apparatus; a sheet supply device configured to store a long paper sheet to be supplied to the image forming apparatus; a sheet feeder device configured to feed the image forming apparatus with the long paper sheet from the sheet supply device; and a sheet collecting device configured to store the long paper sheet having the image formed thereon by the image forming apparatus, wherein the image forming apparatus includes: a conveying unit configured to convey the long paper sheet; an image forming unit configured to form an image on the long paper sheet, the image forming unit including a transferring unit configured to transfer toner onto the long paper sheet with a transfer belt; a fixing unit configured to fix the image onto the long paper sheet having the image formed thereon by the image forming unit; and a control unit configured to control a sheet feed path of the long paper sheet with respect to the transfer belt in accordance with state information about the long paper sheet, the long paper sheet being conveyed to the transferring unit by the conveying unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of an image forming apparatus and an image forming system according to the present invention will be described with reference to the drawings. However, the scope of the invention is not limited to the illustrated examples.

<Example Structures of an Image Forming Apparatus and an Image Forming System of This Embodiment>

Figure 1:
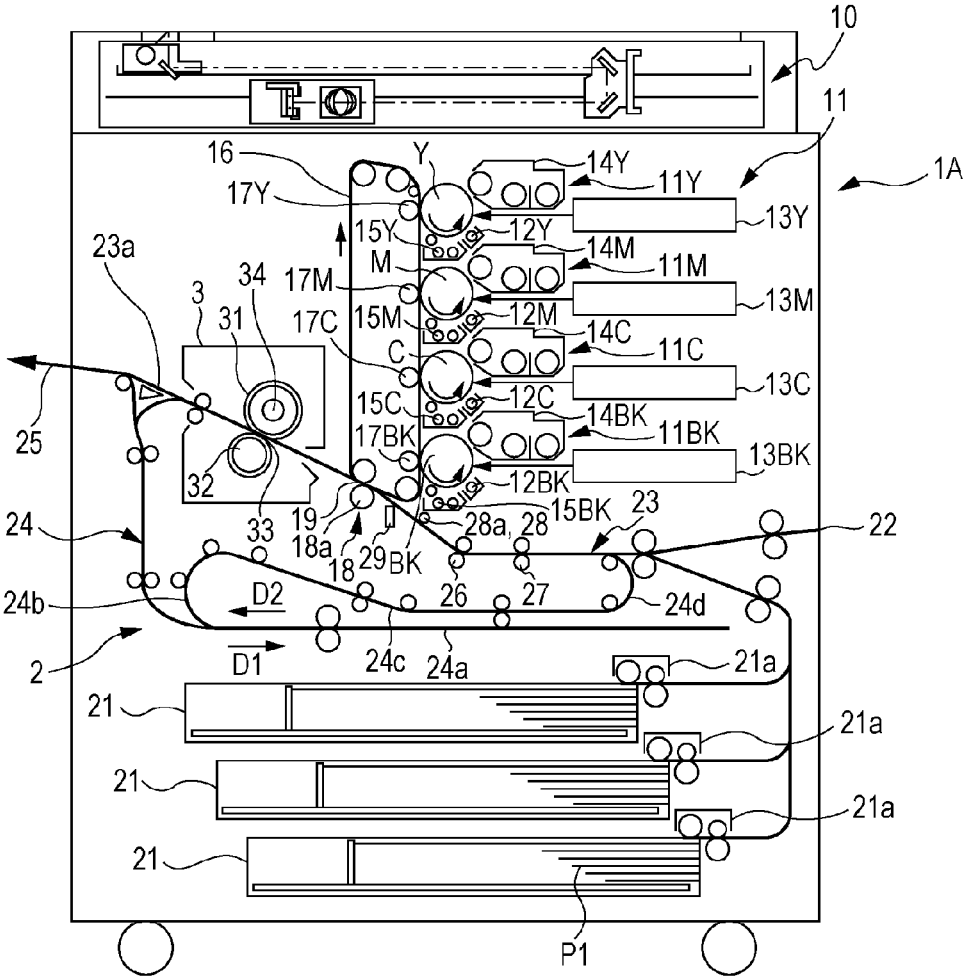
FIG. 1 is a diagram showing an example structure of an image forming apparatus according to an embodiment.
Figure 2:
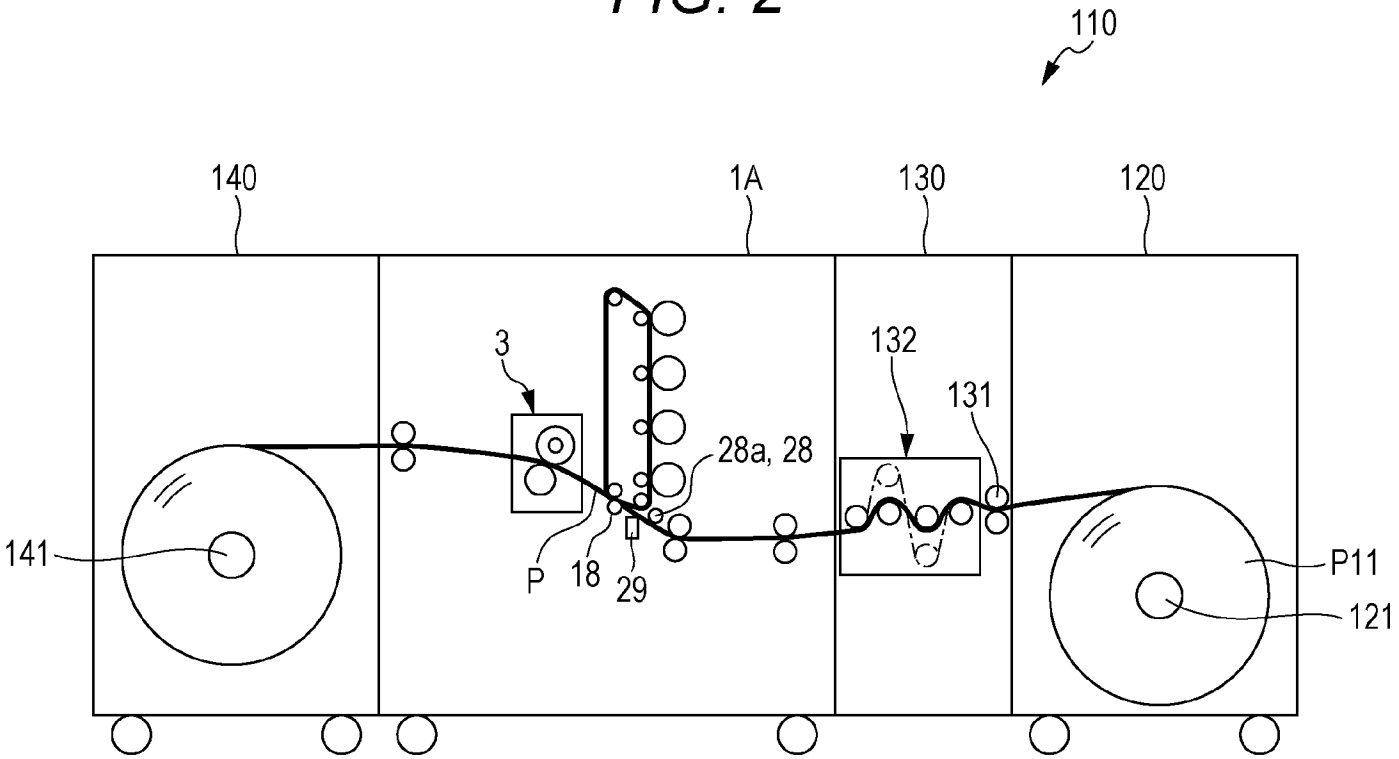
FIG. 2 is a diagram showing an example structure of an image forming system according to the embodiment.

FIG. 1 is a diagram showing an example structure of an image forming apparatus of this embodiment. FIG. 2 is a diagram showing an example structure of an image forming system of this embodiment.

An image forming apparatus 1A of this embodiment is an electrophotographic image forming apparatus, such as a copying machine. In this example, the image forming apparatus 1A is a tandem color image forming apparatus that has photosensitive members vertically arranged to face a single intermediate transfer belt, and forms full-color images.

The image forming system 110 of this embodiment is a structure that forms an image on a long paper sheet P with the image forming apparatus 1A. As shown in FIG. 2, the image forming system 110 includes the image forming apparatus 1A, a sheet supply device 120 that stores the long paper sheet P to be supplied to the image forming apparatus 1A, and a sheet feeder device 130 that feeds the image forming apparatus 1A with the long paper sheet P from the sheet supply device 120. The image forming system 110 also includes a sheet collecting device 140 that stores the long paper sheet P having an image formed thereon by the image forming apparatus 1A.

The long paper sheet P in this embodiment is long paper, film, label paper formed by attaching labels to release paper, or the like, which is longer than the conveyance path between the sheet inlet and the sheet outlet in the image forming apparatus 1A.

The sheet supply device 120 has roll paper P11 that is a wound form of the long paper sheet P and is supported by a shaft 121. The sheet supply device 120 stores the long paper sheet P so that the long paper sheet P can be pulled out therefrom as the roll paper P11 rotates.

The sheet feeder device 130 includes sheet feeding rollers 131 that pull out the long paper sheet P from the sheet supply device 120 and convey the long paper sheet P, and a tension providing device 132 that provides the long paper sheet P with tension in cooperation with the image forming apparatus 1A.

Figure 3:
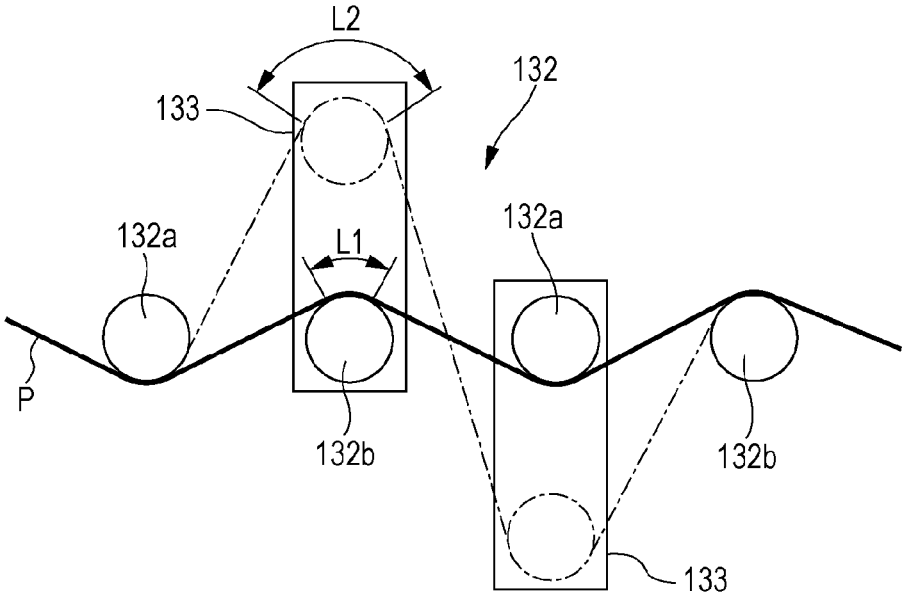
FIG. 3 is a diagram showing an example structure of a tension providing device of the embodiment.

FIG. 3 is a diagram showing an example structure of the tension providing device of this embodiment. The tension providing device 132 is an example of a tension providing means, and includes a first tension providing roller 132*a* in contact with a front surface of the long paper sheet P, and a second tension providing roller 132*b* in contact with the back surface of the long paper sheet P.

The tension providing device 132 includes a roller position moving device 133 that moves one or both of the first and second tension providing rollers 132*a* and 132*b* in a direction substantially perpendicular to the direction of conveyance of the long paper sheet P. With this, the tension providing device 132 is designed to be capable of controlling the relative positions of the first tension providing roller 132*a* and the second tension providing roller 132*b* in a direction substantially perpendicular to the direction of conveyance of the long paper sheet P.

The tension providing device 132 changes the amount of the wound portion of the long paper sheet P by moving the first tension providing roller 132*a* and the second tension providing roller 132*b* in a relative manner in a direction substantially perpendicular to the direction of conveyance of the long paper sheet P.

As indicated by a solid line in FIG. 3, the tension providing device 132 moves the first tension providing roller 132*a* and the second tension providing roller 132*b* toward each other in a relative manner, so that the amount L1 of the wound portion of the long paper sheet P around the first tension providing roller 132*a* and the second tension providing roller 132*b* becomes smaller.

As the tension providing device 132 reduces the amount L1 of the wound portion of the long paper sheet P around the first tension providing roller 132*a* and the second tension providing roller 132*b*, the friction load on the long paper sheet P becomes smaller, and the tension to be applied to the long paper sheet P becomes lower.

As indicated by a dot-and-dash line in FIG. 3, on the other hand, the tension providing device 132 moves the first tension providing roller 132*a* and the second tension providing roller 132*b* away from each other in a relative manner, so that the amount L2 of the wound portion of the long paper sheet P around the first tension providing roller 132*a* and the second tension providing roller 132*b* becomes larger.

As the tension providing device 132 increases the amount L2 of the wound portion of the long paper sheet P around the first tension providing roller 132*a* and the second tension providing roller 132*b*, the friction load on the long paper sheet P becomes greater, and the tension to be applied to the long paper sheet P becomes higher.

The roller position moving device 133 manually controls the relative positions of the first tension providing roller 132*a* and the second tension providing roller 132*b* in accordance with values designated by the operator of the image forming system 110. Alternatively, the roller position moving device 133 may control the relative positions of the first tension providing roller 132*a* and the second tension providing roller 132*b* in accordance with control values based on the tension of the long paper sheet P. Therefore, the tension providing device 132 is designed to be capable of adjusting the tension to be applied to the long paper sheet P being conveyed.

The sheet collecting device 140 includes a rotatively-driven shaft 141, and collects the long paper sheet P ejected from the image forming apparatus 1A by winding the long paper sheet P around the shaft 141.

The sheet feeder device 130 may be included in the image forming apparatus 1A, or may be included in the sheet supply device 120. Alternatively, the sheet feeder device 130 may be an independent device.

Referring back to FIG. 1, the structure of the image forming apparatus 1A is described. As shown in FIG. 1, the image forming apparatus 1A includes a document reading unit 10, an image forming unit 11, a sheet conveying unit 2, and a fixing unit 3.

The document reading unit 10 scans and exposes an image of a document with an optical system of a scanning exposure device, reads the reflected light with a line image sensor, and thus obtains an image signal. An automatic document conveyance device (not shown) that supplies documents to the image forming apparatus 1A may also be provided at an upper portion of the image forming apparatus 1A.

The image forming unit 11 is an example of an image forming means, and includes an image forming unit 11Y that forms a yellow (Y) image, an image forming unit 11M that forms a magenta (M) image, an image forming unit 11C that forms a cyan (C) image, and an image forming unit 11BK that forms a black (BK) image.

The image forming unit 11Y includes a photosensitive drum Y, and a charging unit 12Y, an optical writing unit 13Y, a development device 14Y, and a drum cleaner 15Y, which are placed around the photosensitive drum Y. Likewise, the image forming units 11M, 11C, and 11BK include photosensitive drums M, C, and BK, and charging units 12M, 12C, and 12BK, optical writing units 13M, 13C, and 13BK, development devices 14M, 14C, and 14BK, and drum cleaners 15M, 15C, and 15BK, which are placed around the photosensitive drums M, C, and BK, respectively.

The surface of the photosensitive drum Y is uniformly charged by the charging unit 12Y, and a latent image is formed on the photosensitive drum Y by the optical writing unit 13Y performing scanning exposure. The development device 14Y further performs development with toner, to visualize the latent image on the photosensitive drum Y. As a result, an image (a toner image) in the predetermined color corresponding to yellow is formed on the photosensitive drum Y.

Likewise, the surface of the photosensitive drum M is uniformly charged by the charging unit 12M, and a latent image is formed on the photosensitive drum M by the optical writing unit 13M performing scanning exposure. The development device 14M further performs development with toner, to visualize the latent image on the photosensitive drum M. As a result, a toner image in the predetermined color corresponding to magenta is formed on the photosensitive drum M.

The surface of the photosensitive drum C is uniformly charged by the charging unit 12C, and a latent image is formed on the photosensitive drum C by the optical writing unit 13C performing scanning exposure. The development device 14C further performs development with toner, to visualize the latent image on the photosensitive drum C. As a result, a toner image in the predetermined color corresponding to cyan is formed on the photosensitive drum C.

The surface of the photosensitive drum BK is uniformly charged by the charging unit 12BK, and a latent image is formed on the photosensitive drum BK by the optical writing unit 13BK performing scanning exposure. The development device 14BK further performs development with toner, to visualize the latent image on the photosensitive drum BK. As a result, a toner image in the predetermined color corresponding to black is formed on the photosensitive drum BK.

An intermediate transfer belt 16 that is an example of a transfer belt in the form of a belt-like intermediate transfer member is wound around a driving roller, and the driving roller is rotatively driven, so that the intermediate transfer belt 16 is driven in the direction indicated by an arrow. As a result, the images formed on the photosensitive drums Y, M, C, and BK are sequentially transferred to predetermined positions on the intermediate transfer belt 16 by primary transfer rollers 17Y, 17M, 17C, and 17BK.

A secondary transfer unit 18 then transfers the image in the respective colors from the intermediate transfer belt 16 onto a long paper sheet P that is conveyed at a predetermined time by the sheet conveying unit 2. The secondary transfer unit 18 is an example of a transfer means. As a secondary transfer roller 18*a* is pressed against the intermediate transfer belt 16, a transfer nip portion 19 is formed. The secondary transfer roller 18*a* is rotatively driven at the same speed as the intermediate transfer belt 16, so that the image is transferred onto the long paper sheet P while the long paper sheet P is being conveyed.

To transfer the toner image onto the long paper sheet P, the secondary transfer unit 18 applies a positive voltage to the long paper sheet P with the secondary transfer roller 18*a* from the back surface of the long paper sheet P. As a result, after the long paper sheet P passes through the secondary transfer unit 18, the image formation surface of the long paper sheet P on which the toner image is transferred is negatively charged, and the back surface is positively charged.

The image forming apparatus 1A is a structure that can also perform an image forming process on a paper sheet P1 as a single cut sheet, and the sheet conveying unit 2 that stores paper sheets P1 in this example includes sheet feeder trays 21 and sheet feeding units 21*a* that deliver the paper sheets P1 stored in the sheet feeder trays 21. The sheet conveying unit 2 also includes a main conveyance path 23 in which a long paper sheet P pulled out by the sheet feeder device 130 or a paper sheet P1 supplied from a sheet feeder tray 21 is conveyed, and a reverse conveyance path 24 that reverses the paper sheet P1.

The main conveyance path 23 forms the conveyance path extending from the sheet feeder trays 21 and a sheet inlet 22 to a sheet outlet 25. The conveyance path extending from the sheet inlet 22 joins the main conveyance path 23 on the upstream side of the joining point between the main conveyance path 23 and the reverse conveyance path 24. In the image forming system 110 shown in FIG. 2, the sheet supply device 120 and the sheet feeder device 130 are connected to the sheet inlet 22, and the sheet collecting device 140 is connected to the sheet outlet 25.

The sheet conveying unit 2 includes resist rollers 26 that correct a tilt (also called a skew) of the long paper sheet P being conveyed in the main conveyance path 23 and deviation of the position of the long paper sheet P in the width direction perpendicular to the conveying direction. The sheet conveying unit 2 also includes loop rollers 27 that bring each paper sheet into contact with the resist rollers 26.

The resist rollers 26 are formed with a pair of rollers that face each other and nip the long paper sheet P being conveyed in the main conveyance path 23. The resist rollers 26 each have a shaft perpendicular to the direction of conveyance of the long paper sheet P, and rotate in the direction of conveyance of the long paper sheet P.

The loop rollers 27 are formed with a pair of rollers that face each other and nip the long paper sheet P being conveyed in the main conveyance path 23. The loop rollers 27 are provided on the upstream side of the resist rollers 26 in the direction of conveyance of the long paper sheet P. The loop rollers 27 each have a shaft perpendicular to the direction of conveyance of the long paper sheet P, and rotate in the direction of conveyance of the long paper sheet P, to convey the long paper sheet P.

While the resist rollers 26 are stopped, the loop rollers 27 convey the long paper sheet P, and bring the top edge of the long paper sheet P into contact with a nip portion 26*a* formed with the contact portion between the pair of rollers. The long paper sheet P is then conveyed until being bent into a loop, so that the tilt of the long paper sheet P in the direction parallel to the surface of the long paper sheet P is corrected.

After the tilt of the long paper sheet Pis corrected, the resist rollers 26 are driven and rotated in the direction of conveyance of the long paper sheet P, so that the long paper sheet P is conveyed while being nipped. The resist rollers 26 are further moved in the width direction of the long paper sheet P perpendicular to the direction of conveyance of the long paper sheet P, so that the position of the long paper sheet P in the width direction is corrected. The series of paper position correcting operations to correct deviation of the position of the long paper sheet P in the width direction while the long paper sheet P is being conveyed as described above are called resist fluctuations.

The image forming apparatus 1A includes a sheet feed path adjusting device 28 in the sheet conveying unit 2 on the upstream side of the transfer nip portion 19 in the direction of conveyance of the long paper sheet P. The image forming apparatus 1A further includes a sheet position sensor 29 between the transfer nip portion 19 and the sheet feed path adjusting device 28.

Figure 4:
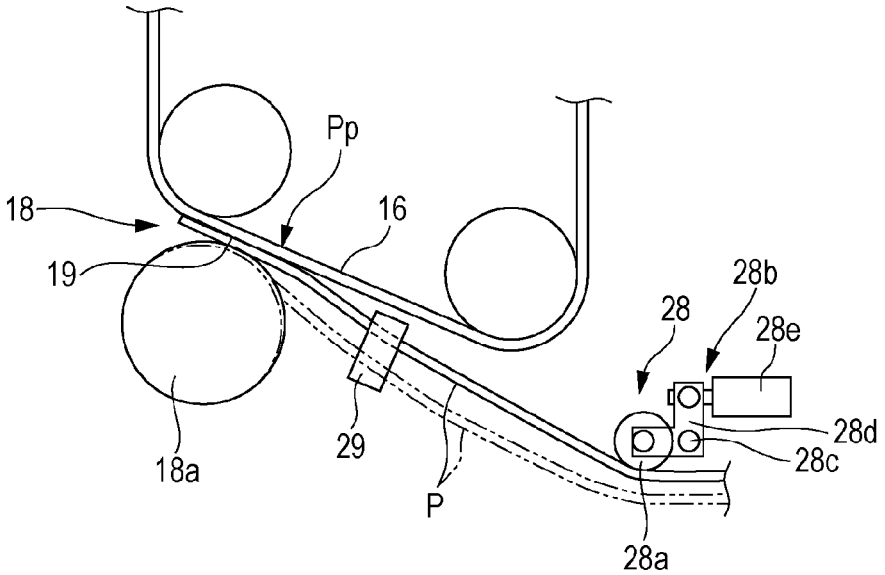
FIG. 4 is a diagram showing an example structure of a sheet feed path adjusting device of the embodiment.

FIG. 4 is a diagram showing an example structure of the sheet feed path adjusting device of this embodiment. The sheet feed path adjusting device 28 is an example of a sheet feed path adjusting means. The sheet feed path adjusting device 28 includes a path position adjusting roller 28*a* that is part of the sheet feed path of the long paper sheet P, and a roller moving device 28*b* that moves the path position adjusting roller 28*a* in the plane direction of the long paper sheet P substantially perpendicular to the direction of conveyance of the long paper sheet P.

The path position adjusting roller 28*a* is formed with a driven roller that rotates following the conveyance of the long paper sheet P. The roller moving device 28*b* includes an arm 28*c* that rotatably supports the path position adjusting roller 28*a*, and a solenoid 28*e* that moves the path position adjusting roller 28*a* in the plane direction of the long paper sheet P by causing the arm 28*c* to rotate about a shaft 28*d*. With this structure, the sheet feed path adjusting device 28 moves the path position adjusting roller 28*a* to a position controlled by the driving of the solenoid 28*e*.

While the top edge of the long paper sheet P is located at the transfer nip portion 19, the sheet feed path adjusting device 28 has the path position adjusting roller 28*a* located near the intermediate transfer belt 16 in contact with the long paper sheet P. In this structure, the path position adjusting roller 28*a* is moved in the plane direction of the long paper sheet P, so that the sheet feed path on the upstream side of the transfer nip portion 19 moves in the plane direction of the long paper sheet P relative to the direction of conveyance of the long paper sheet P.

In this manner, the position in the plane direction of the long paper sheet P being conveyed to the transfer nip portion 19 is controlled. Thus, the sheet feed path of the long paper sheet P on the upstream side of the transfer nip portion 19 that is displaced with a difference in the tension of the long paper sheet P or the like is maintained in a predetermined position, and the contact start position Pp of the long paper sheet P with respect to the intermediate transfer belt 16 is controlled on the upstream side of the transfer nip portion 19. The long paper sheet P enters the transfer nip portion 19, while being wound around the secondary transfer roller 18*a*. The contact start position Pp is set in the vicinity of the position where the long paper sheet P is wound around the secondary transfer roller 18*a*, and is located on the downstream side of the conveyance path of the secondary transfer roller 18*a* by a predetermined amount.

The sheet position sensor 29 is an example of a sheet position sensing means, and senses the position of the long paper sheet P in its plane direction as the state information about the long paper sheet P being conveyed to the transfer nip portion 19 on the upstream side of the transfer nip portion 19 in the direction of conveyance of the long paper sheet P.

Referring back to FIG. 1, the reverse conveyance path 24 branches from the main conveyance path 23 on the downstream side of the fixing unit 3, and has a switching gate 23*a* at the branching point between the main conveyance path 23 and the reverse conveyance path 24. The reverse conveyance path 24 includes a first reverse conveyance path 24*a* that branches from the main conveyance path 23 and extends substantially in the horizontal direction below the main conveyance path 23. In the first reverse conveyance path 24*a*, the direction of conveyance of a paper sheet P1 is reversed from the direction indicated by an arrow D1 to the direction indicated by an arrow D2.

The reverse conveyance path 24 includes a second reverse conveyance path 24*b* that branches upward from the first reverse conveyance path 24*a* in the direction of conveyance indicated by the arrow D2 and is bent into an U-like shape, and a third reverse conveyance path 24*c* that extends from the second reverse conveyance path 24*b* and runs along the first reverse conveyance path 24*a*. The reverse conveyance path 24 further includes a fourth reverse conveyance path 24*d* that extends from the third reverse conveyance path 24*c*, is bent into an U-like shape, and joins the main conveyance path 23.

In the image forming apparatus 1A, a paper sheet P1 that has been conveyed along the main conveyance path 23 and has passed through the transfer nip portion 19 and the fixing unit 3 has an image formed on the surface facing upward. In a case where images are to be formed on both surfaces of a paper sheet P1, the paper sheet P1 having an image formed on the surface facing upward is conveyed from the main conveyance path 23 into the first reverse conveyance path 24*a* of the reverse conveyance path 24, so that the image-formed surface faces downward.

The paper sheet P1 conveyed into the first reverse conveyance path 24*a* is then conveyed from the second reverse conveyance path 24*b* into the third reverse conveyance path 24*c*, so that the image-formed surface faces upward. The paper sheet P1 conveyed into the third reverse conveyance path 24*c* then conveyed from the fourth reverse conveyance path 24*d* into the main conveyance path 23, so that the image-formed surface faces downward. The paper sheet P1 is reversed in this manner, and an image can be formed on the other surface that now faces upward.

The fixing unit 3 is an example of a fixing means, and performs a fixing process on a long paper sheet P having an image transferred thereonto, to fix the image to the long paper sheet P. The fixing unit 3 includes rotatively-driven fixing rollers 31 and 32 as a pair of fixing conveyance members that are pressed against each other. As the fixing rollers 31 and 32 are pressed against each other, a fixing nip portion 33 is formed in the fixing unit 3.

The fixing unit 3 also includes a fixing heater 34 as a heating means for heating a fixing member. The fixing heater 34 heats the fixing roller 31. The fixing heater 34 is turned on by application of current, and may be formed with a halogen lamp, for example. The fixing unit 3 conveys the paper sheet P as the fixing rollers 31 and 32 are rotatively driven, and performs pressure fixing with the pair of fixing rollers 31 and 32 and thermal fixing with the fixing heater 34, so that the image is fixed onto the long paper sheet P.

<Example of Control Functions of the Image Forming Apparatus and the Image Forming System of This Embodiment>

Figure 5:
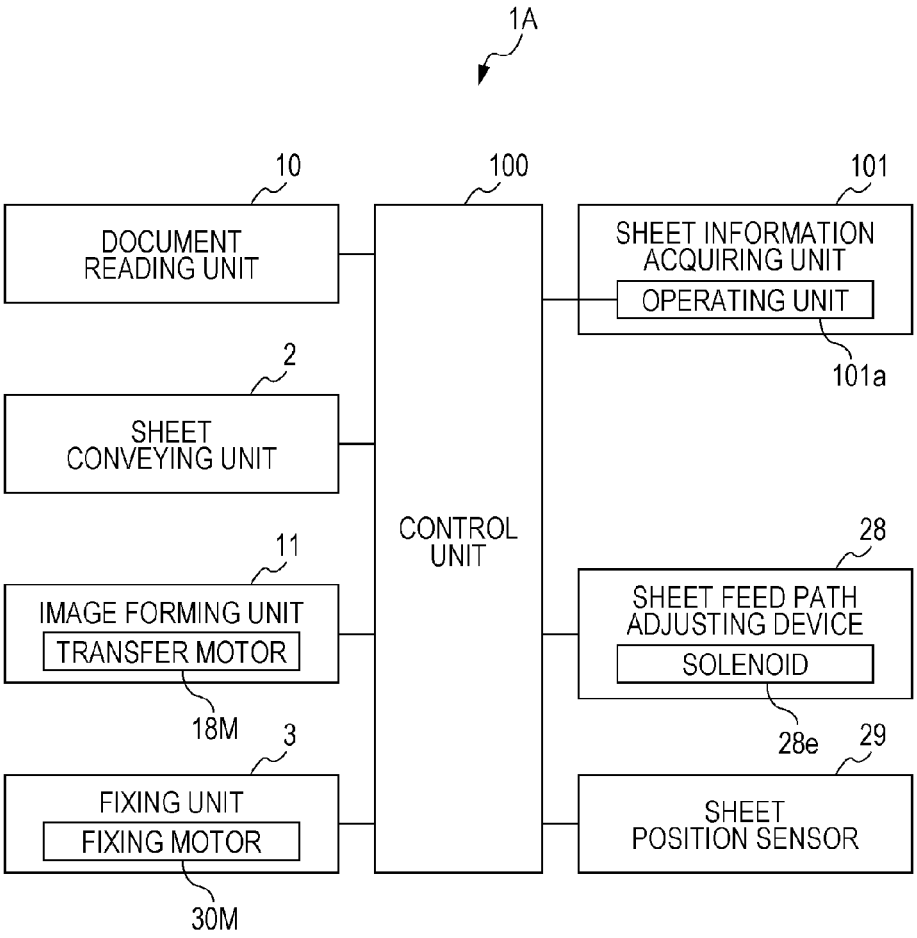
FIG. 5 is a functional block diagram showing an example of a control function of the image forming apparatus and the image forming system of the embodiment.

FIG. 5 is a functional block diagram showing an example of a control function of the image forming apparatus and the image forming system of this embodiment. Referring to FIG. 5, the control function for maintaining the position of the sheet feed path of a long paper sheet P being conveyed to the transfer nip portion 19 in an operation to form an image on the long paper sheet P is described.

The image forming apparatus 1A includes a control unit 100 that performs a series of control processes to supply a long paper sheet P, form an image, and eject the long paper sheet P in this example. The control unit 100 is an example of a control means. The control unit 100 includes a microprocessor called a CPU or an MPU, and memories such as a RAM and a ROM as storage means.

The image forming apparatus 1A also includes a sheet information acquiring unit 101 that acquires sheet information such as the class of a long paper sheet P. The sheet information acquiring unit 101 is an example of a sheet information acquiring means, and is formed with an operating unit 101*a* serving as an operating means that selects basis weight, sheet type, size, and the like for a long paper sheet P, and the like.

As for the outline of an operation to form an image on a long paper sheet P in the image forming apparatus 1A, the control unit 100 controls the image forming unit 11 in accordance with image data acquired from a document by the document reading unit 10 or image data acquired from outside. The control unit 100 also controls the sheet conveying unit 2 and a transfer motor 18M that conveys the long paper sheet P at the secondary transfer unit 18, to transfer a toner image onto the long paper sheet P. Further, the control unit 100 controls the fixing heater 34 and a fixing motor 30M that conveys the long paper sheet P at the fixing unit 3, to fix the toner image to the long paper sheet P.

The control unit 100 senses the position of the sheet feed path of the long paper sheet P on the upstream side of the transfer nip portion 19 with the sheet position sensor 29, and controls the position of the path position adjusting roller 28*a* so that the sheet feed path of the long paper sheet P is located in a predetermined position.

In a printing operation on a long paper sheet P, electric discharge before the transfer nip is prevented by bringing the long paper sheet P into contact with the intermediate transfer belt 16 before the top edge of the long paper sheet P reaches the transfer nip portion 19. Therefore, on the upstream side of the transfer nip portion 19, the contact start position Pp of the long paper sheet P with respect to the intermediate transfer belt 16 is set within a predetermined range when the tension of the long paper sheet P is within an appropriate range.

Meanwhile, the tension of a long paper sheet P varies with sheet type, the amount of deformation of the secondary transfer roller 18*a* against which the long paper sheet P is pressed at the transfer nip portion 19 varies with the tension of the long paper sheet P, and the sheet feed path shifts its position in accordance with the plane direction of the long paper sheet P.

For example, in a case where the tension of the long paper sheet P is high, the amount of deformation of the secondary transfer roller 18*a* becomes larger, and the sheet feed path of the long paper sheet P shifts its position in such a direction that the contact start position Pp of the long paper sheet P with respect to the intermediate transfer belt 16 becomes closer to the transfer nip portion 19, as indicated by double-dot-and-dash line in FIG. 4. As the contact start position Pp moves closer to the transfer nip portion 19, electric discharge before the transfer nip might cause in the sheet feed path.

In a case where the tension of the long paper sheet P is low, on the other hand, the sheet feed path of the long paper sheet P shifts its position in such a direction that the contact start position Pp of the long paper sheet P with respect to the intermediate transfer belt 16 becomes further away from the transfer nip portion 19. As the contact start position Pp moves further away from the transfer nip portion 19, the long paper sheet P is scraped against the intermediate transfer belt 16, and might be damaged.

In view of this, in the control unit 100, control information for the sheet feed path adjusting device 28 is set in accordance with the position of the sheet feed path detected by the sheet position sensor 29 with respect to the long paper sheet P being conveyed with the tension set by the tension providing device 132. The control information is formed with the program(s) to be executed by the control unit 100, an operation table for determining an operation of the sheet feed path adjusting device 28 from the position of the sheet feed path sensed by the sheet position sensor 29, and the like.

<Example of Operations of the Image Forming Apparatus and the Image Forming System of This Embodiment>

Figure 6:
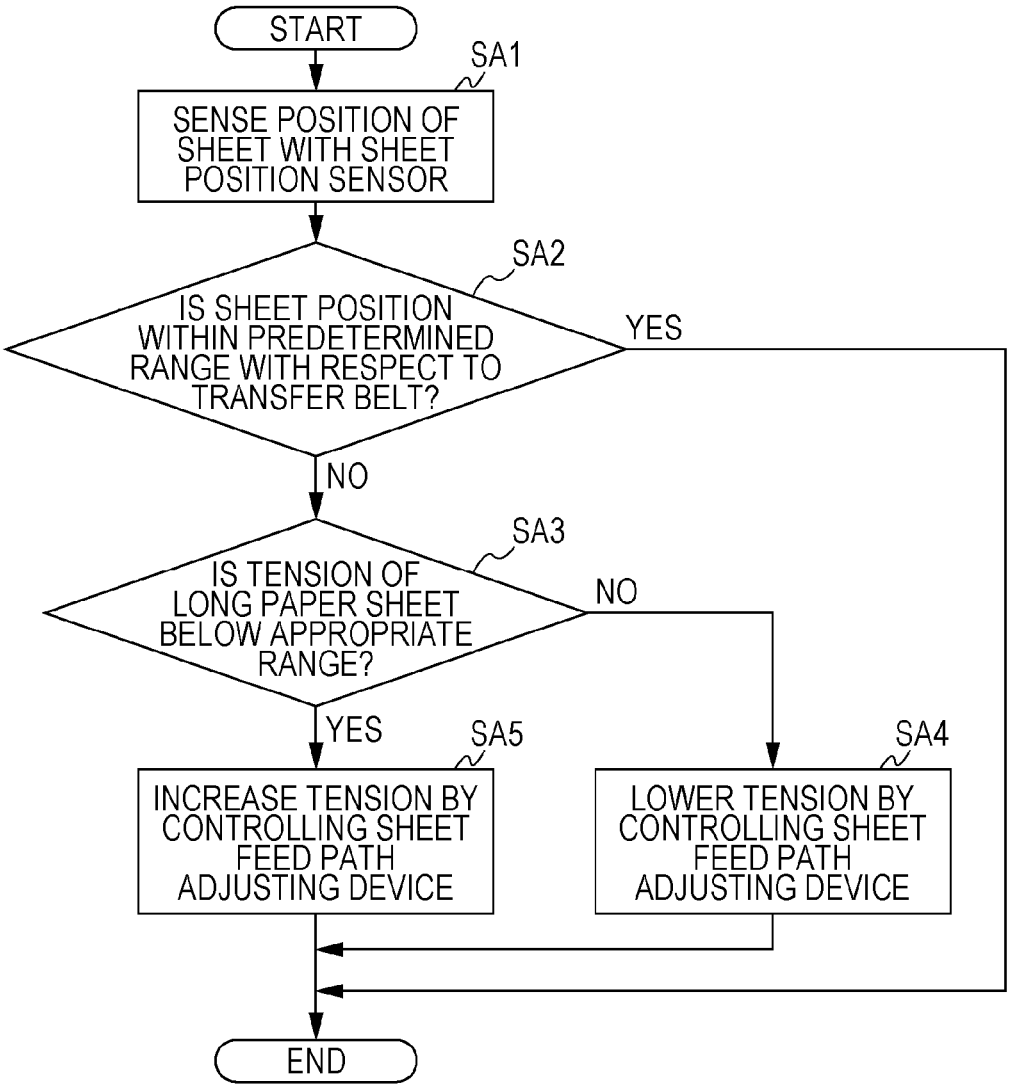
FIG. 6 is a flowchart showing an example of operations of the image forming apparatus and the image forming system of the embodiment.

FIG. 6 is a flowchart showing an example of operations of the image forming apparatus and the image forming system of this embodiment. Referring to the respective drawings, operations of the image forming apparatus and the image forming system of this embodiment are described below.

The control unit 100 controls the fixing motor 30M and the transfer motor 18M so that the linear velocity at the secondary transfer roller 18*a* of the secondary transfer unit 18 and the linear velocity at the fixing roller 31 of the fixing unit 3 become substantially the same. In this manner, the velocity of conveyance of a long paper sheet P becomes substantially the same at the secondary transfer unit 18 and the fixing unit 3.

In an operation to form an image on a long paper sheet P, the control unit 100 in step SA1 in FIG. 6 senses the position of the sheet feed path of the long paper sheet P on the upstream side of the transfer nip portion 19 with the sheet position sensor 29 at a predetermined time before the long paper sheet P being conveyed by the sheet conveying unit 2 reaches the transfer nip portion 19. Instep SA2 in FIG. 6, the control unit 100 determines whether the position of the sheet feed path of the long paper sheet P sensed by the sheet position sensor 29 is within an appropriate range, or whether the position of the sheet feed path of the long paper sheet P with respect to the intermediate transfer belt 16 is appropriate.

If the control unit 100 determines the position of the sheet feed path of the long paper sheet P sensed by the sheet position sensor 29 not to be within an appropriate range, the control unit 100 in step SA3 in FIG. 6 determines whether the tension of the long paper sheet P exceeds an appropriate range or whether the tension of the long paper sheet P is below the appropriate range, in accordance with the position of the sheet feed path of the long paper sheet P.

If the control unit 100 determines the position of the sheet feed path of the long paper sheet P sensed by the sheet position sensor 29 to be further away from the intermediate transfer belt 16 than the appropriate range, or determines the tension of the long paper sheet P to be higher than the appropriate range, the control unit 100 in step SA4 in FIG. 6 controls the sheet feed path adjusting device 28 in accordance with the position of the sheet feed path of the long paper sheet P, to control the position of the path position adjusting roller 28*a* so that tension of the long paper sheet P falls within the appropriate range. In this example, the path position adjusting roller 28*a* is moved in an upward direction in which the amount of the wound portion of the long paper sheet P around the path position adjusting roller 28*a* becomes smaller. In this manner, the tension to be applied to the long paper sheet P is lowered.

If the control unit 100 determines the position of the sheet feed path of the long paper sheet P sensed by the sheet position sensor 29 to be closer to the intermediate transfer belt 16 than the appropriate range, or determines the tension of the long paper sheet P to be lower than the appropriate range, on the other hand, the control unit 100 in step SA5 in FIG. 6 controls the sheet feed path adjusting device 28 in accordance with the position of the sheet feed path of the long paper sheet P, to control the position of the path position adjusting roller 28*a* so that tension of the long paper sheet P falls within the appropriate range. In this example, the path position adjusting roller 28*a* is moved in a downward direction in which the amount of the wound portion of the long paper sheet P around the path position adjusting roller 28*a* becomes larger. In this manner, the tension to be applied to the long paper sheet P is increased.

<Examples of Function Effects of the Image Forming Apparatus and the Image Forming System of This Embodiment>

In a case where the tension providing device 132 is designed to adjust the tension of a long paper sheet through a manual operation performed by the operator, the tension cannot be adjusted while the long paper sheet P is being conveyed. Therefore, it is not possible to cope with changes in the tension during the conveyance.

In the image forming apparatus 1A and the image forming system 110 of this embodiment, on the other hand, even when the tension of a long paper sheet P changes, the contact start position Pp of the long paper sheet P with respect to the intermediate transfer belt 16 is within a predetermined range when the tension of the long paper sheet P is within an appropriate range. Accordingly, electric discharge before the transfer nip can be prevented by bringing the long paper sheet P into contact with the intermediate transfer belt 16 before the top edge of the long paper sheet P reaches the transfer nip portion 19.

Thus, electric discharge before the transfer nip of the long paper sheet P can be prevented, and a toner image transfer defect due to electric discharge before the transfer nip can be avoided in this embodiment.

<Modifications of the Image Forming Apparatus and the Image Forming System of This Embodiment>

In the above example, the tension of a long paper sheet P is determined in accordance with the position of the sheet feed path of the long paper sheet P sensed by the sheet position sensor 29. However, the tension of a long paper sheet P may be determined from the state information about the long paper sheet P, such as the sheet type, the basis weight, and the like, which are set beforehand in the image forming process. For example, the sheet feed path adjusting device 28 may have control information that specifies positions of the path position adjusting roller 28*a* with respect to sheet types, such as plain paper and coated paper.

Furthermore, the sheet feed path adjusting device 28 may have control information that specifies positions of the path position adjusting roller 28*a* in accordance with changes in electrical state depending on a load applied onto a motor in accordance with the tension of a long paper sheet P, such as the current value and the voltage value of the motor for conveying the long paper sheet P.

Further, the operator may control the position of the path position adjusting roller 28*a* by looking at a test image or the like formed on a long paper sheet P. The control unit 100 may display an adjustment screen that associates the formed image with the control information for the sheet feed path adjusting device 28 on the operating unit 101*a*, and control the position of the path position adjusting roller 28*a* in accordance with the control information for the sheet feed path adjusting device 28 selected by the operator operating the adjustment screen.

In the above example, the tension of a long paper sheet P is controlled by adjusting the position of the path position adjusting roller 28*a*, so that the contact start position Pp of the long paper sheet P with respect to the intermediate transfer belt 16 is controlled. However, the nip pressure that is the pressing force of the secondary transfer roller 18*a* against the intermediate transfer belt 16 may be controlled. For example, the nip pressure is lowered when the tension of the long paper sheet P is high, and the nip pressure is increased when the tension of the long paper sheet P is low.

The present invention is to be applied to an image forming apparatus that forms an image by transferring and fixing a toner image onto a long paper sheet, and to an image forming system that includes a device that supplies a long paper sheet to an image forming apparatus and collects the long paper sheet from the image forming apparatus.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a conveying unit configured to convey a long paper sheet;

an image forming unit configured to form an image on the long paper sheet, the image forming unit including a transferring unit, the transferring unit including a transfer belt for transferring toner onto the long paper sheet;

a fixing unit configured to fix the image onto the long paper sheet having the image formed thereon by the image forming unit; and a control unit configured to control a sheet feed path of the long paper sheet with respect to the transfer belt in accordance with state information about the long paper sheet, while the long paper sheet contacts the transfer belt at a contact start position and is being conveyed to the transferring unit by the conveying unit, wherein the control unit performs the controls of the sheet feed path by setting tension of the long paper sheet to maintain the contact start position within a predetermined range along the transfer belt, a path segment of the sheet feed path starts from the contact start position and is located on an upstream side of the transfer belt relative to a direction of conveyance of the long paper sheet being conveyed by the conveying unit, and the control by the control unit of the sheet feed path moves the path segment in a direction perpendicular to the direction of conveyance.

2. The image forming apparatus according to claim 1, further comprising a sheet feed path adjusting unit configured to move the path segment in the direction perpendicular to the direction of conveyance to reduce a distance, along the direction perpendicular to the direction of conveyance, between the path segment and the transfer belt, the sheet feed path adjusting unit being disposed on the upstream side of the transfer belt.

3. The image forming apparatus according to claim 1, wherein the sheet feed path defines plane in which the long paper sheet travels, and the image forming apparatus further comprises:

a sheet position sensing unit configured to sense a position of the long paper sheet in the direction perpendicular to the direction of conveyance and perpendicular to the plane in which the long paper sheet travels, the position sensed by the sheet position sensing unit being the state information, in accordance with which, the control unit controls the sheet feed path.

4. The image forming apparatus according to claim 1, wherein the control unit controls the sheet feed path in accordance with the state information about the long paper sheet, the state information specifying a class of the long paper sheet.

5. The image forming apparatus according to claim 1, further comprising an operating unit for adjusting the sheet feed path of the long paper sheet, wherein the control unit controls the sheet feed path, in the direction perpendicular to the direction of conveyance, in accordance with a user selection on the operating unit.

6. The image forming apparatus according to claim 1, wherein the transferring unit includes a transfer roller configured to press the long paper sheet against the transfer belt, and the control unit controls a pressing force of the transfer roller against the transfer belt in accordance with the state information about the long paper sheet.

7. An image forming system comprising:

an image forming apparatus;

a sheet supply device configured to store a long paper sheet to be supplied to the image forming apparatus;

a sheet feeder device configured to feed the image forming apparatus with the long paper sheet from the sheet supply device; and a sheet collecting device configured to store the long paper sheet having the image formed thereon by the image forming apparatus, wherein the image forming apparatus includes:

a conveying unit configured to convey the long paper sheet;

an image forming unit configured to form an image on the long paper sheet, the image forming unit including a transferring unit, the transferring unit including a transfer belt for transferring toner onto the long paper sheet;

a fixing unit configured to fix the image onto the long paper sheet having the image formed thereon by the image forming unit; and a control unit configured to control a sheet feed path of the long paper sheet with respect to the transfer belt in accordance with state information about the long paper sheet, while the long paper sheet contacts the transfer belt at a contact start position and is being conveyed to the transferring unit by the conveying unit, wherein the control unit performs the controls of the sheet feed path by setting tension of the long paper sheet to maintain the contact start position within a predetermined range along the transfer belt, a path segment of the sheet feed path starts from the contact start position and is located on an upstream side of the transfer belt relative to a direction of conveyance of the long paper sheet being conveyed by the conveying unit, and the control by the control unit of the sheet feed path moves the path segment in a direction perpendicular to the direction of conveyance.

8. An image forming apparatus comprising:

a conveying unit configured to convey a long paper sheet;

an image forming unit configured to form an image on the long paper sheet, the image forming unit including a transferring unit, the transferring unit including a transfer belt for transferring toner onto the long paper sheet;

a fixing unit configured to fix the image onto the long paper sheet having the image formed thereon by the image forming unit; and a control unit configured to control a sheet feed path of the long paper sheet with respect to the transfer belt in accordance with state information about the long paper sheet, while the long paper sheet contacts the transfer belt at a contact start position and is being conveyed to the transferring unit by the conveying unit, wherein the feed path is at an upstream side of a transfer nip portion, the sheet feed path defines a plane in which the long paper sheet travels, the control is performed by setting tension of the long paper sheet to maintain the contact start position within a predetermined range along the transfer belt, and the control by the control unit moves the plane in which the long paper sheet travels.

* * * * *